United States Patent [19]

Mathot

[11] Patent Number: 4,782,729

[45] Date of Patent: Nov. 8, 1988

[54] ANIMAL FIBER CUTTING MACHINE

[76] Inventor: Ernest R. Mathot, 1429 Virginia Ave., Unit "O" , Baldwin Park, Calif. 91706

[21] Appl. No.: 95,105

[22] Filed: Sep. 11, 1987

[51] Int. Cl.[4] ..... B26D 1/62; B26D 3/18

[52] U.S. Cl. ..... 83/408; 83/342; 83/44; 83/672; 83/505

[58] Field of Search ..... 83/408, 342, 343, 346, 83/44, 42, 341, 346, 672, 404, 505

[56] References Cited

U.S. PATENT DOCUMENTS

| | | | |
|---|---|---|---|
| 3,217,988 | 11/1965 | Lightfoot et al. | 83/408 X |
| 3,494,232 | 2/1970 | Lindau | 83/408 X |
| 3,837,249 | 9/1974 | Long et al. | 83/408 |
| 3,875,836 | 4/1975 | Hutchinson et al. | 83/408 X |
| 3,975,974 | 8/1976 | Harris | 83/342 X |
| 4,205,570 | 6/1980 | Soodalter | 83/408 X |
| 4,334,449 | 6/1982 | Hinz et al. | 83/342 |

*Primary Examiner*—Donald R. Schran

*Attorney, Agent, or Firm*—William W. Haeflinger

[57] ABSTRACT

A machine for cutting animal tissue into pieces, comprises (a) a frame, (b) slicer means including slicers carried by the frame to rotate for slicing the tissue into elongated strands fed along parallel paths of widths determined by spacing of the slicers, (c) rotary cutter means including cutters carried by the frame to rotate and intercept the strands fed along said paths, and for cutting the strands crosswise thereof and at intervals predetermined by rotary spacing of said cutters, thereby to form said pieces having predetermined sizes.

10 Claims, 4 Drawing Sheets

FIG. 5.
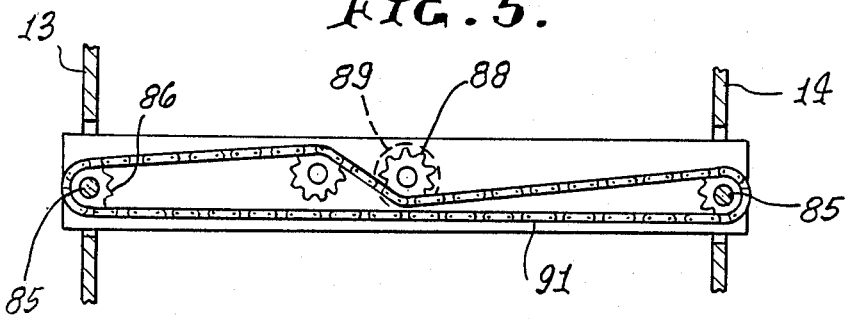
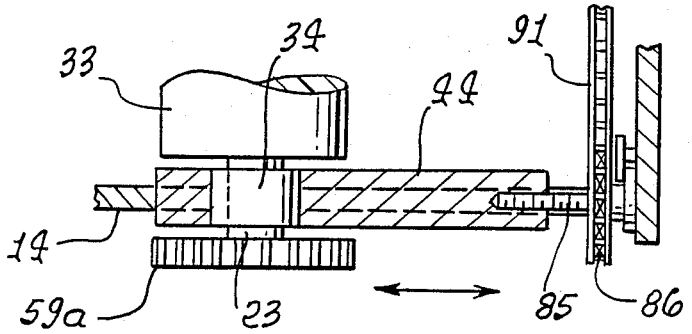
FIG. 6.
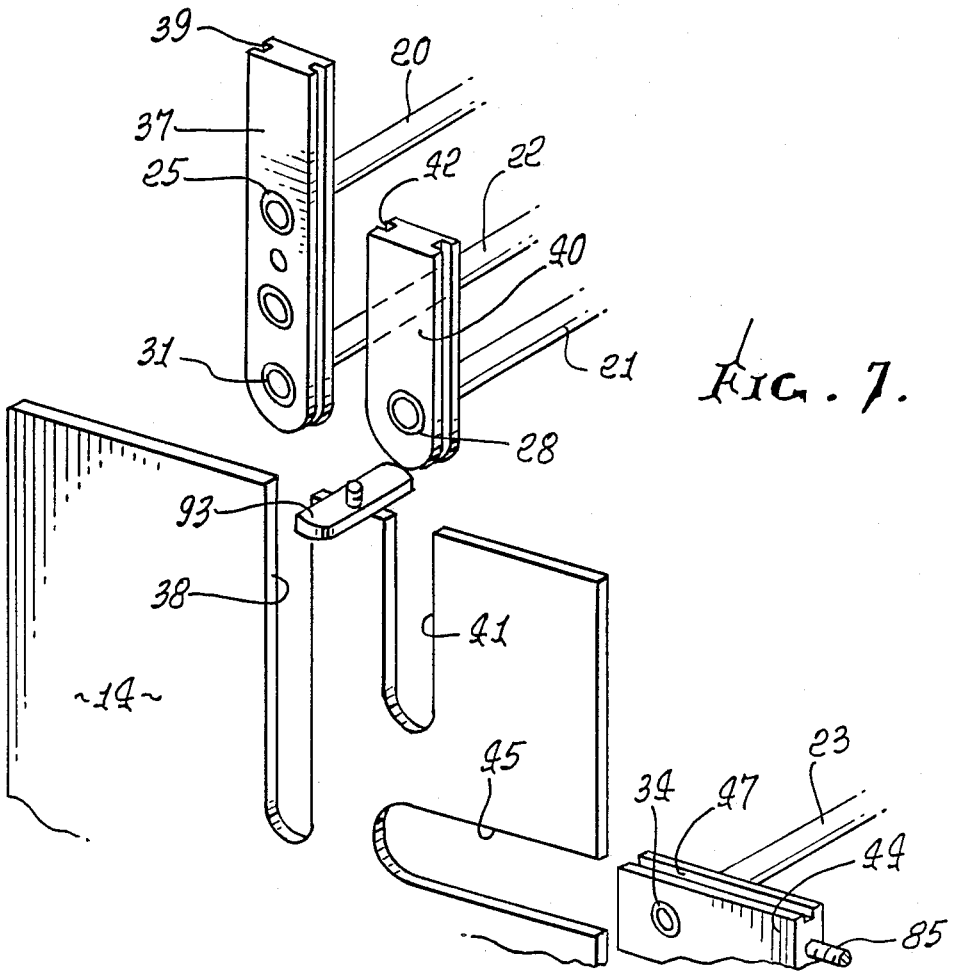
FIG. 7.

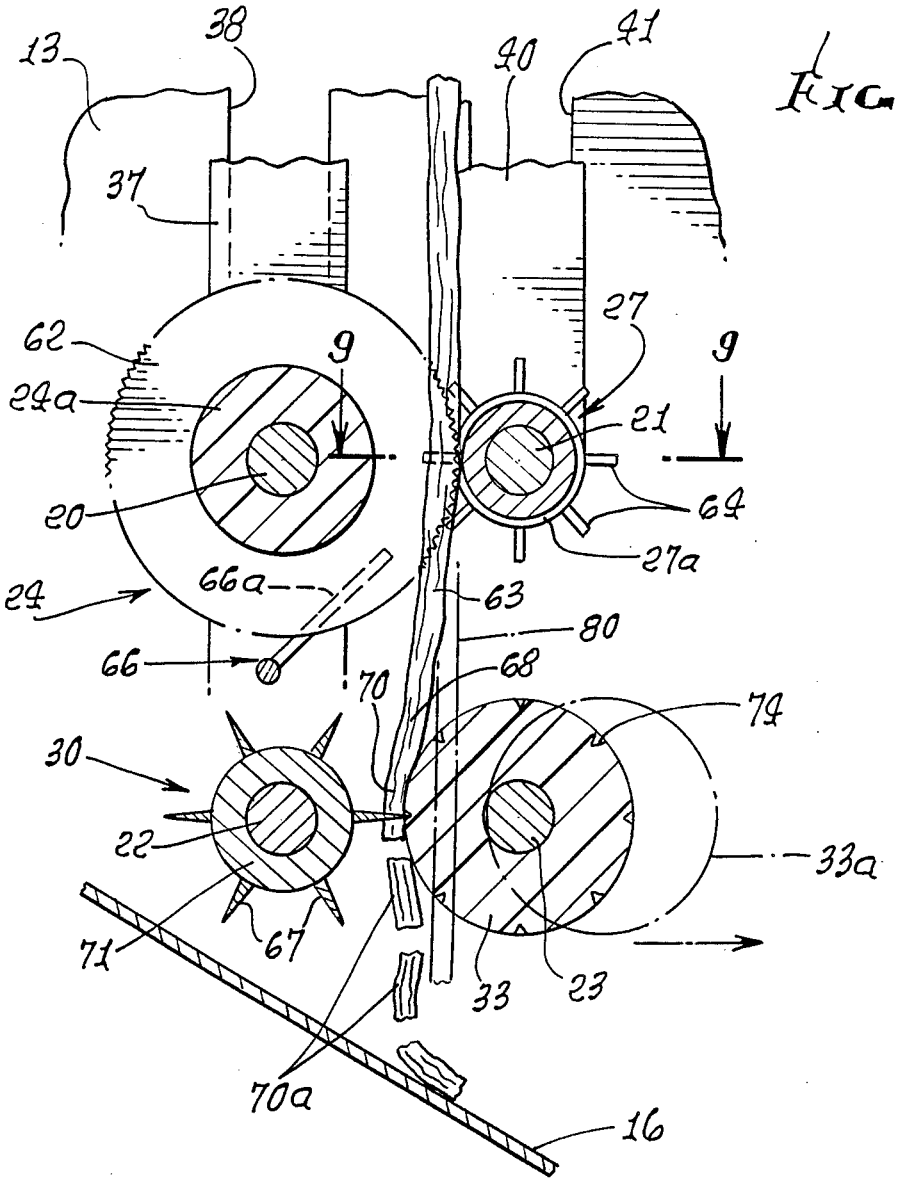
FIG. 8.
FIG. 9.
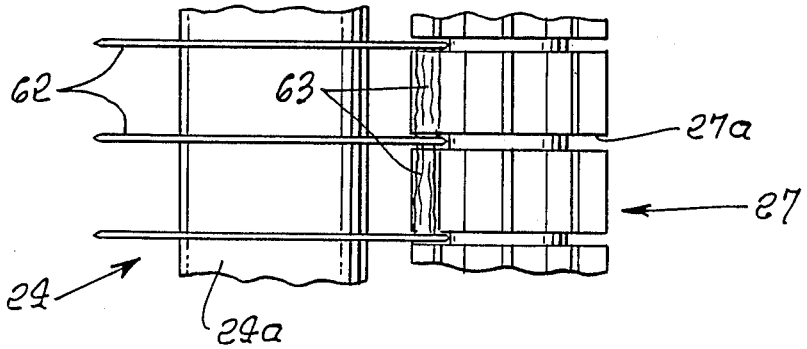

ANIMAL FIBER CUTTING MACHINE

BACKGROUND OF THE INVENTION

This invention relates generally to animal tissue processing, and more particularly to a highly advantageous machine for rapidly producing meat pieces or strands, of predetermined size, as for example are used in preparing menudo or fajita.

Meat pieces or strands for preparing menudo and/or fajita are commonly produced by manual cutting of meat slabs. This is time consuming and laborious. Need exists for simple, effective apparatus to rapidly and automatically prepare such meat pieces and strands.

SUMMARY OF THE INVENTION

It is a major object of the invention to provide apparatus meeting the above need. Basically, it comprises:

(a) a frame, (b) slicer means including slicers carried by the frame to rotate for slicing the tissue into elongated strands fed along parallel paths of widths determined by spacing of the slicers, (c) rotary cutter means including cutters carried by the frame to rotate and intercept the strands fed along said paths, and for cutting the strands crosswise thereof and at intervals predetermined by rotary spacing of said cutters, thereby to form said pieces having predetermined sizes.

As will appear, the slicer means may comprise an elongated shaft, and said slicers comprise parallel slicer discs which are spaced apart along the length of the shaft; and the cutter means may comprise an elongated shaft carrying said cutters which are spaced apart circumferentially of the shaft, said slicer means shaft, and said cutter means shaft having generally parallel axes of rotation. Further, the cutters typically extend helically along and about an axis defined by the cutter means shaft, and are spaced below the level of said slicer means shaft, said two shafts extending generally horizontally. A back-up roller may be spaced from and parallel to the cutter means shaft so that tips defined by the helical cutters intercept a cylinder defined by the outer surfaces of the back-up roller; and that roller typically has grooves that receive said cutter tips as the roller and cutter means shaft rotate, and including gearing operatively connected with the roller and cutter means shafts to control synchronized rotation thereof. Also, a slot-roller means may be employed to have slots positioned to receive outer portions of the slicer discs as the discs are rotated, and also having peripheral teeth to engage and drive the strands.

Further, means may be provided to increase the spacing between the back-up roller and the cutter means shaft, to prevent cutting of the strands by the cutters, whereby elongated strips of said tissue are produced and pass between the cutters and back-up roller.

These and other objects and advantages of the invention, as well as the details of an illustrative embodiment, will be more fully understood from the following specification and drawings, in which:

DRAWING DESCRIPTION

FIG. 5 is a fragmentary vertical section taken on lines 5—5 of FIG. 1;

FIG. 6 is a fragmentary vertical section taken on lines 6—6 of FIG. 2;

FIG. 7 is an exploded perspective showing details of bearing plate mounting;

FIG. 8 is an enlarged fragmentary elevation, taken in section on lines 8—8 of FIG. 1; and FIG. 9 is a fragmentary section taken on lines 9—9 of FIG. 8.

DETAILED DESCRIPTION

Figure 1:
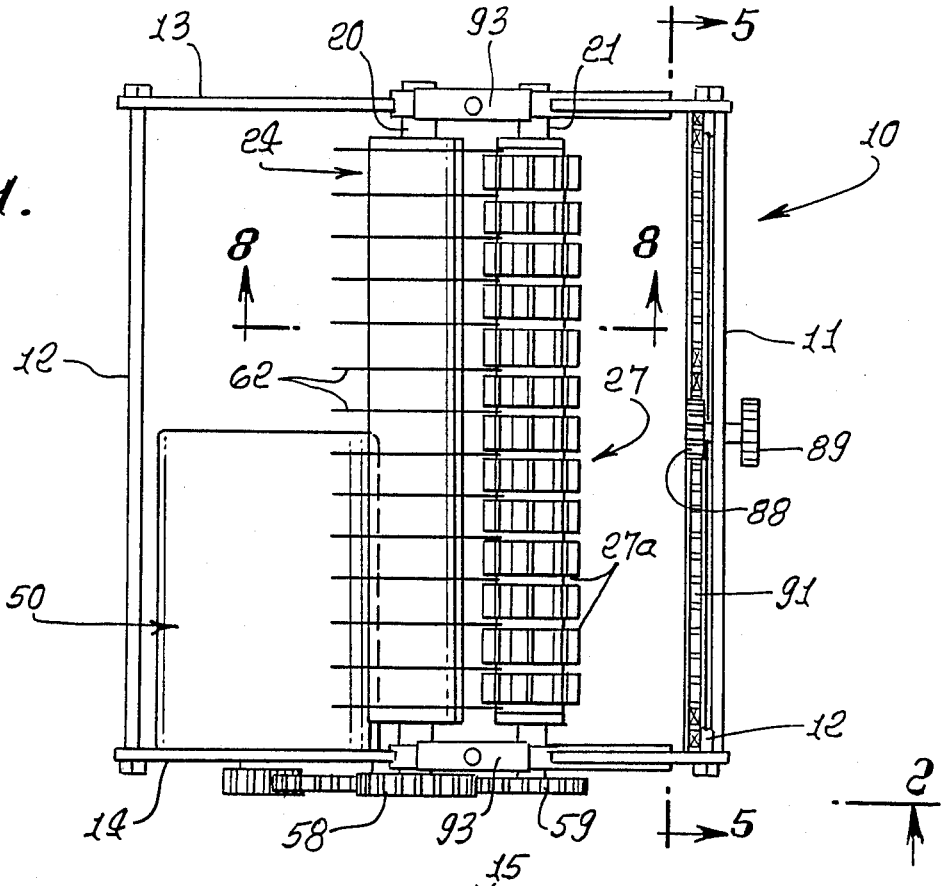
FIG. 1 is a plan view of apparatus incorporating the invention.

In the drawings, a frame 10 includes side wall or plate 11, and end walls or plates 13 and 14, all extending vertically. The frame is open at the top, for downward feeding of animal tissue (such as beef to be formed into menudo pieces, or fajita strips), in the direction of arrow 15 (see FIG. 2); the frame is open at the bottom for downward discharge of such pieces or strips, on inclined plate 16. Also shown are connecting rods 12 helping to hold the walls in assembled condition.

Located within the housing are four parallel shafts 20, 21, 22 and 23, mounted to extend between end plates 13 and 14, and for rotation. Rod 20 carries slicer means 24, and is mounted for rotation by bearings 25; rod 21 carries slot roller means 27 and is mounted for rotation by bearings 28; rod 22 carries cutter means 30, and is mounted for rotation by bearings 31; and rod 23 carries a back-up roller 33 and is mounted for rotation by bearings 34.

The rods 20 and 22 have their opposite ends supported for rotation by sub-plates 37 removably attachable to vertical slots 38 in walls 13 and 14. See for example FIGS. 2, 3 and 7. As shown, sub-plate 37 may be vertically slidable in the slots 38, as via tongue and groove connection (see for example vertical grooves 39 in sub-plate 37 that receive edges of the plate 13, adjacent the slot). Sub-plates 37 define or carry the bearings 25 and 31. Thus, the sub-plates 37 are easily vertically removable, for cleaning of the slicer means 24 and cutter means 30.

Figure 4:
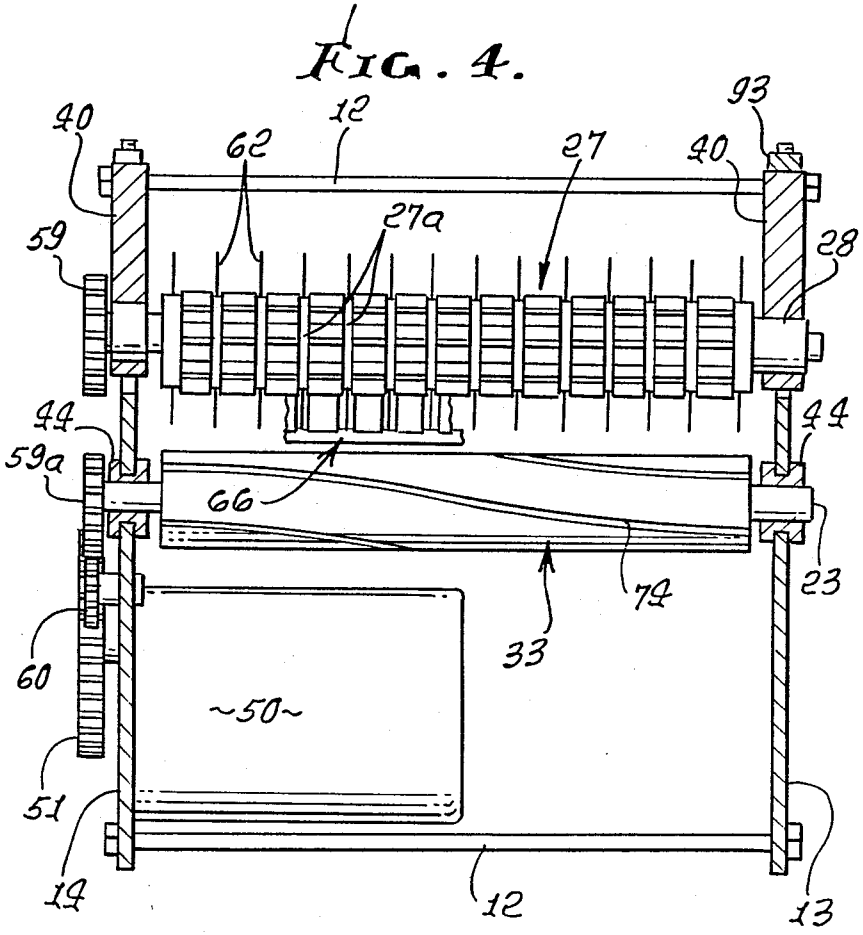
FIG. 4 is a vertical section on lines 4—4 of FIG. 2.

Similarly, the rod 21 has its opposite ends supported for rotation by a sub-plate 40, removably attachable to vertical slots 41 in walls 13 and 14. See for example FIGS. 2, 4 and 7. As shown, sub-plate 40 may be vertically slidable in the slots 41, as via tongue and groove connections (see for example vertical grooves 42) in sub-plates 40 that receive edges of the plate 13 adjacent the slot. Sub-plates 40 define or carry the bearings 28. Thus, the sub-plate 40 is easily removable for cleaning of the slot roller means 27.

Also, the rod 23 has its opposite ends supported for rotation by a sub-plate 44 removably attachable to horizontal slots 45 in end walls 13 and 14. See for example FIGS. 2, 6 and 7. As shown, sub-plate 44 may be horizontally slidable in the slots 45 as via tongue and groove connections (see for example horizontal grooves 47) in edges of sub-plate 44 that receive edges of the plate 13 adjacent the slot, in FIG. 7. Sub-plate 44 carry or define the bearings 34. Thus, the sub-plates 44 is retractable for cleaning of the back-up roller means 33.

Figure 2:
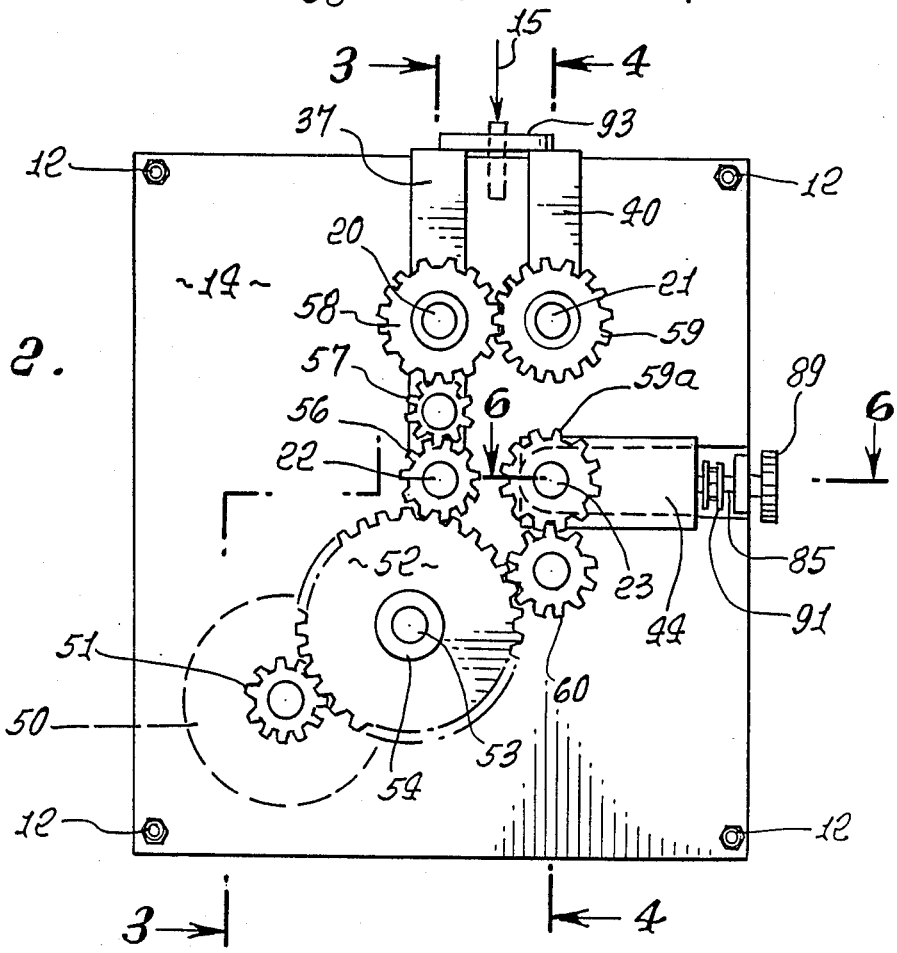
FIG. 2 is an elevation taken on lines 2—2 of FIG. 1.

All the rods are simultaneously rotatable, by a drive that includes a common motor 50 located between plates 13 and 14, and carried by plate 14, as shown. Referring to FIG. 2, a spur gear 51 at the outer side of plate 14 is driven by the motor, and it meshes with a larger diameter idler spur gear 52 carried by plate 14, via shaft 53 and bearing 54. Gear 52 in turn meshes with a spur gear 56 attached to rod 22, to rotate same. Gear 56 in turn drives a gear 58 attached to rod 20, via an intermediary idler gear 57 rotatably mounted to sub-plate 37 via a shaft and bearing; and gear 58 meshes with and drives a gear 59 attached to rod 21. Also, gear 52 drives a gear **59*a* attached to shaft 23, via an intermediary idler gear 60 rotatably mounted to plate 14, as via a suitable shaft and bearing. All gears are at the outer side of the plate 14**.

The slicer means 24 includes parallel slicer discs 62 carried by and rotatable by the shaft 20, the discs spaced apart along the shaft length to cut the meat into elongated strands 63 fed along downward and parallel paths. See FIG. 8. This is aided by rotation of the synchronized slot roller means 27. The latter has peripheral slots **27*a* to receive outer portions of the slicer discs, so that the strands are completely cut and isolated, one from another. Teeth or legs 64 on the roller means 27 engage and drive the strands downwardly. A comb shaped component or device 66 has tangs 66*a*, positioned to engage the strands fed downwardly from the slicer means, to prevent roll-up of the strands around the slicer means cylinder 24*a* that carries the slicer discs 62. Element 66 extends between and is carried by the sub-plates 37, and is angled upwardly as shown, so that the tangs project between the discs 62**.

Figure 3:
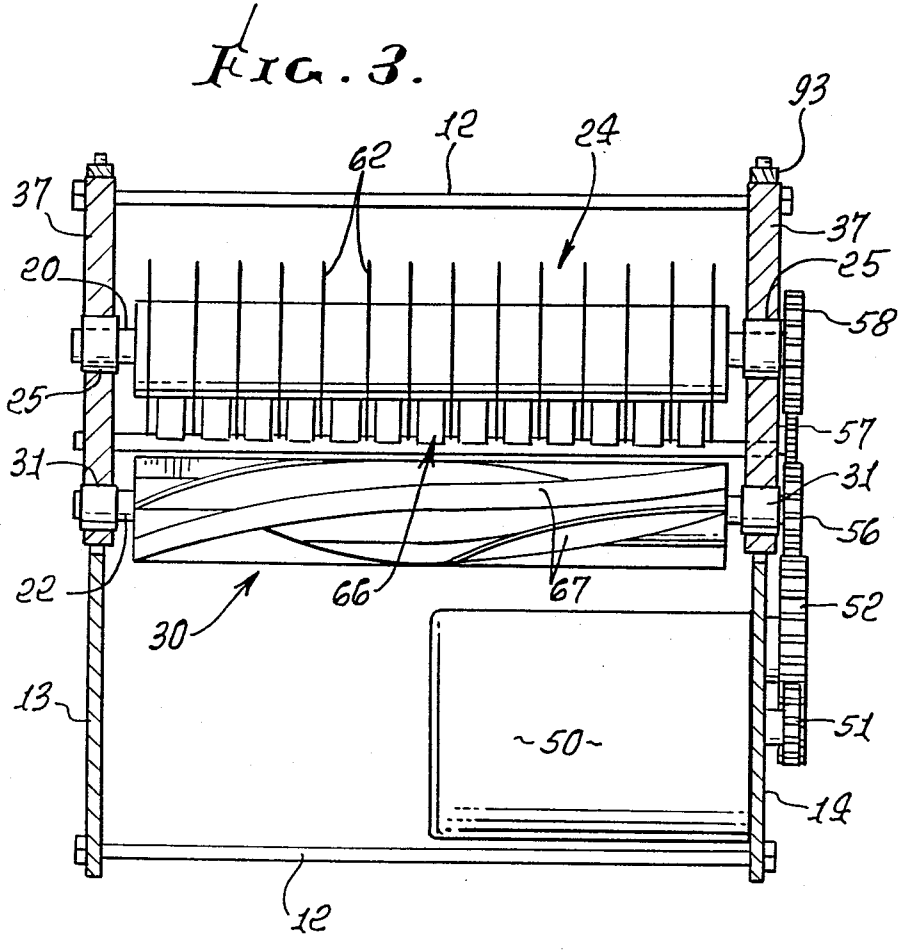
FIG. 3 is a vertical section on lines 3—3 of FIG. 2.

Rotary cutters means 30 includes cutter 67 carried to rotate and intercept downwardly fed strands (see path 68 in FIG. 8), the cutters 67 extending transversely for cutting the strands 70 crosswise thereof and at intervals predetermined by rotary spacing of the cutters 67, thereby to form the meat pieces **70*a* having predetermined sizes. The cutter means 30 includes a cylinder 71 on shaft 22 and carrying the cutters 67, which extend helically around the cylinder 71, axially thereof, as seen in FIG. 3. The rotating back-up roller 33 has helical grooves 74 that mesh with and receive the tips of the cutters 67 as the cutters rotate, whereby the pieces 70*a* are clearly severed, one from another. Note in FIG. 8 that the cutters 67 are normally positioned below slicer means 24, and offset to the left of a vertical plane 80 tangent to the edges of the slicer discs closest to the slot roller 23, whereby roller 33 normally deflects the strands 70 toward the cutters 67, for cutting of pieces 70*a***.

Means is provided to increase the spacing between the back-up roller 33 and the cutter means 30, to prevent cutting of the strands by the cutters 67, whereby elongated strips or strands of meat tissue are produced and pass downwardly between 30 and 33. Such product strands are used in preparing the food known as fajita. The means 80 so increase the spacing serves to retract the sub-plate to the right, in FIGS. 2, 5, 7 and 8. One such means includes jack screws 85 which mesh with threads on the sub-plate. As the screws are rotated, they retract the sub-plate to the right (or advance them to the left to FIG. 8 solid line position of the means 33). Broken lines **33*a* in FIG. 8 show completed retraction. FIGS. 5 and 6 show a chain drive to rotate the screws 85. Chains 91 engage driven sprockets 86 mounted on the screws; and a drive sprocket 88 engages the chains, centrally, and is rotated by a knob 89 at the outer side of plate 11**, to accomplish the adjustment.

See also hold-down 93, for slidable plates 37 and 40.

I claim:

1. In a machine for cutting tough, fibrous animal tissue into pieces, the combination comprising (a) a frame, (b) slicer means including slicers carried by the frame to rotate for slicing the tissue into elongated strands fed along parallel paths of widths determined by spacing of the slicers, said slicer means comprising an elongated shaft, and said slicers comprise parallel slicer discs which are spaced apart along the length of the shaft, (c) rotary cutter means including cutters carried by the frame to rotate and intercept the strands fed along said paths, and for cutting the strands crosswise thereof and at intervals predetermined by rotary spacing of said cutters, thereby to form said pieces having predetermined sizes, said rotary cutter means comprising an elongated shaft carrying said cutters which are spaced apart circumferentially of the shaft, said cutters extending helically along and about an axis defined by the cutter means shaft, (d) and including a back-up roller spaced from and parallel to the cutter means shaft so that tips defined by the helical cutters intercept a cylinder defined by the outer surfaces of the back-up roller; the back-up roller having helical grooves that receive said cutter tips as the roller and cutter means shaft rotate, and including gearing operatively connected with the roller and cutter means shafts to control synchronized rotation thereof, (e) and including slot roller means having slots positioned to receive outer portions of the slicer discs as the discs are rotated, and also having peripheral teeth to engage to drive the strands, said teeth projecting between said slicer discs.

2. The combination of claim 1 wherein said slicer means shaft and said cutter means shaft have generally parallel axes of rotation.

3. The combination of claim 2 wherein said cutter means shaft is spaced below the level of said slicer means shaft, said two shafts extending generally horizontally.

4. The combination of claim 1 wherein said slicer means comprises an elongated shaft, and said slicers comprise parallel slicer discs which are spaced apart along the length of the shaft.

5. The combination of claim 4 wherein said gearing is also operatively connected to the slicer means shaft for controlling synchronized rotation of said three shafts.

6. The combination of claim 2 including a comb-shaped component having tangs positioned to engage the strands fed from the slicer means to prevent roll-up of the strands.

7. The combination of claim 1 including means to increase the spacing between the back-up roller and the cutter means shaft, to prevent cutting of the strands by the cutters, whereby elongated strips of said tissue are produced and pass between the cutters and back-up roller.

8. The combination of claim 7 wherein the cutters are normally positioned below and offset from a vertical plane tangent to the edges of the slicer disc closest to the back-up roller, whereby the back-up roller normally deflects the strands toward the cutters, and is movable away from the cutters to allow the strands to pass downwardly free of the cutters.

9. The combination of claim 1 wherein the frame includes an upright plate defining a slot, there being a bearing sub-plate romovably attachable to the slot, and at least one of the slicer means and cutter means includes rod means supported for rotation by the sub-plate.

10. The combination of claim 1 wherein the frame includes two upright plates defining upright and generally horizontal slots, there being sub-plates movably mounted in the slots, to slide therealong, the sub-plates mounted in the upright slots carrying shafts associated with the slicers, cutters and slot roller means, and the horizontal slots carrying shafts associated with the back-up roller means.

* * * * *